US005234117A

United States Patent [19]

Garvin

[11] Patent Number: 5,234,117

[45] Date of Patent: Aug. 10, 1993

[54] STRAW ADAPTOR FOR BABY BOTTLE

[76] Inventor: Dawn R. Garvin, 1328 Torrey St., Davis, Calif. 95616

[21] Appl. No.: 807,065

[22] Filed: Dec. 10, 1991

[51] Int. Cl.[5] ..... A61J 9/00

[52] U.S. Cl. ..... 215/11.4; 215/11.1; 215/1 A; 215/229; 220/709; 220/705

[58] Field of Search ..... 215/11.4, 11.1, 229, 215/1 A; 220/705, 706, 707, 708, 709, 710, 711, 713, 714, 717; 239/33; 272/570

[56] References Cited

U.S. PATENT DOCUMENTS

| | | | |
|---|---|---|---|
| 90,606 | 5/1869 | Thompson et al. . | |
| 662,345 | 11/1900 | Britton et al. | 239/33 |
| 1,309,994 | 4/1919 | McAuliffe . | |
| 2,655,279 | 10/1953 | Wolf | 215/11.1 X |
| 2,984,377 | 5/1961 | Biondi | 215/11.1 |
| 3,840,153 | 10/1974 | Devlin | 220/709 X |
| 4,090,650 | 5/1978 | Gotta | 215/11.1 X |
| 4,153,170 | 5/1979 | Aquarian | 215/11 R |
| 4,537,324 | 8/1985 | Wang | 215/1 A X |
| 4,754,887 | 7/1988 | Ou | 215/11.4 |
| 4,898,290 | 2/1990 | Cueto | 215/11.1 |
| 4,969,564 | 11/1990 | Cohen et al. | 215/11.1 |
| 4,994,076 | 2/1991 | Guss | 606/236 |
| 5,054,631 | 10/1991 | Robbins, III | 215/229 X |

FOREIGN PATENT DOCUMENTS

| | | | |
|---|---|---|---|
| 27652 | 6/1884 | Fed. Rep. of Germany | 215/11.4 |
| 131912 | 5/1901 | Fed. Rep. of Germany | 215/11.1 |
| 0208564 | 3/1909 | Fed. Rep. of Germany | 215/11.1 |
| 601698 | 2/1960 | Italy . | |
| 0007673 | of 1886 | United Kingdom | 215/11.4 |
| 411379 | 6/1934 | United Kingdom | 215/11.1 |
| 2067416 | 7/1981 | United Kingdom | 215/11.4 |

*Primary Examiner*—Allan N. Shoap
*Assistant Examiner*—Paul A. Schwarz
*Attorney, Agent, or Firm*—Joseph E. Gerber

[57] ABSTRACT

A straw adaptor for a baby bottle comprised of an elongate tube having a first end adapted for drinking from and a second end adapted to be submerged in a drinking liquid in a baby bottle is disclosed. The first end is curved and flattened and the second end is straight and extends nearly to the bottom of a baby bottle. The device further includes a flattened, disc-shaped collar nearer its first end, this collar being integral with the tube and oriented in perpendicular relation to its long axis. The collar has a concentric, upstanding ridge on its upper face which registers with the inside edge of a threaded, annular baby bottle cap. Alternative embodiments further include a unidirectional valve and a mouthpiece with convolutions for added flexibility.

9 Claims, 6 Drawing Sheets

STRAW ADAPTOR FOR BABY BOTTLE

BACKGROUND OF THE INVENTION

1. Field Of The Invention

The present invention relates generally to baby bottles, and more specifically to fluid delivery apparatus for a baby bottle.

2. Description Of The Related Art

The conventional fluid delivery apparatus for use on a baby bottle is a resilient nipple having a hole in its tip through which fluid is able to pass. Such a nipple is commonly adapted to nest within a threaded annular cap having a central circular opening. This cap is screwed onto the bottle's neck which bears a set of mating threads, thereby securely fastening the nipple to the bottle.

Bottle feeding with a conventional nipple best approximates a mother's breast to a nursing baby. However, this nipple has several drawbacks, one of which usually becomes apparent within a few months of the time a baby reaches the stage where it is able to sit upright. Around that age, the baby is likely to demand an increased flow of fluid from the bottle. And, the mother is likely to be weary of constantly attending to the baby's need to have the bottle tipped at a sufficient angle for proper fluid delivery. It is at this stage that parents most commonly attempt to wean the child from the bottle to more mature methods of drinking liquids such as from a cup or a straw. However, these methods are prone to causing spills, and are therefore only practical under a parent's watchful eye until the child gets a bit older and develops some level of proficiency in their practice.

Spills may be less likely if a covered drinking vessel with a protruding straw commonly known as a "sports bottle" is used, although the straw normally employed in the construction of such bottles is fairly rigid and it projects a substantial distance upward from the vessel's cap. Thus, such a straw presents a hazard to a small child if the vessel is bumped while the child is drinking, or while the straw is close to the child's face. Sports bottles are also usually rather large in diameter and are therefore difficult for a child to grasp.

A great variety of different types of apparatus have been proposed for use by children in that transitional phase between nipple feeding and more mature feeding methods. The elements of these commonly include flexible hoses, various lengths of stiff tubing, nipples with different types of coupling mechanisms for mating with such hoses or tubing, and various clips, clamps and valves. Some are adapted for attachment to a baby bottle, and others are not.

The parent who has a child at the stage where more mature feeding methods can be learned and more sophisticated vessels and utensils can be used, commonly remains in possession of a good collection of conventional baby bottle paraphernalia. This paraphernalia has value in that it is usually very durable, easy to sterilize and quite standardized in the interchangeability of its parts among different brands. Accordingly, it would be very desirable to offer parents a way to continue to use these various interchangeable parts, while weaning the child and teaching the child to practice advanced feeding methods.

As the most natural step in the use of the mouth for a child to learn after nipple feeding is the action needed to draw liquid through a straw, it is to this end that an improvement over the previously available apparatus should be directed. Thus, a device is needed that fits a standard baby bottle, is easy for a child to use and presents no danger to the child in its use. Further, it should be easy to keep clean.

SUMMARY OF THE INVENTION

The baby bottle straw of the present invention is adapted to overcome the above-noted shortcomings and to fulfill the stated needs. In its essence, it is comprised of an elongate tube having first and second ends wherein the tube's first end is adapted for drinking from and wherein its second end is adapted to be submerged in a drinking liquid in the bottle, these elements being in combination with a flattened, disc-shaped collar integral with the tube and oriented in perpendicular relation to its long axis.

The resulting device mates well with a standard baby bottle and, when so mated, yields an apparatus that is easy for a child to grasp and drink from, and presents no danger to the child in its use. And, it is easy to keep clean.

Still further objects, features and advantages of the inventive baby bottle straw disclosed herein will be apparent from the drawings and following detailed description thereof.

DESCRIPTION OF THE PREFERRED EMBODIMENT

Figure 1:
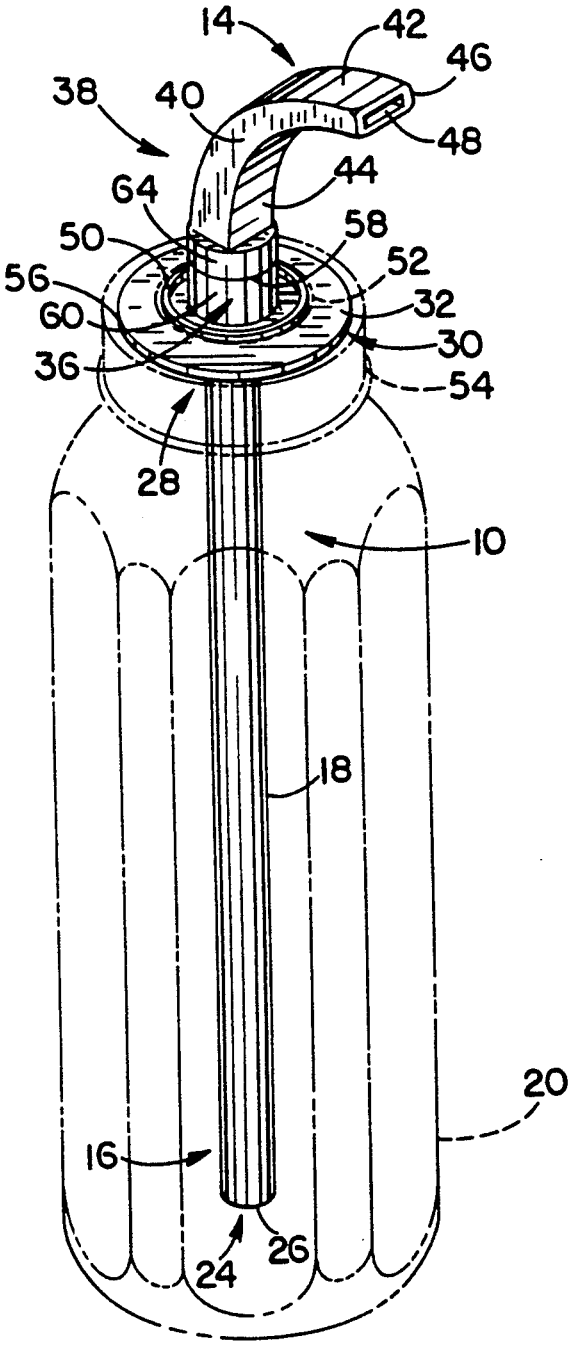
FIG. 1 is a perspective view of the baby bottle straw of the present invention shown mounted in a baby bottle for use, the baby bottle being shown in phantom.
Figure 2:
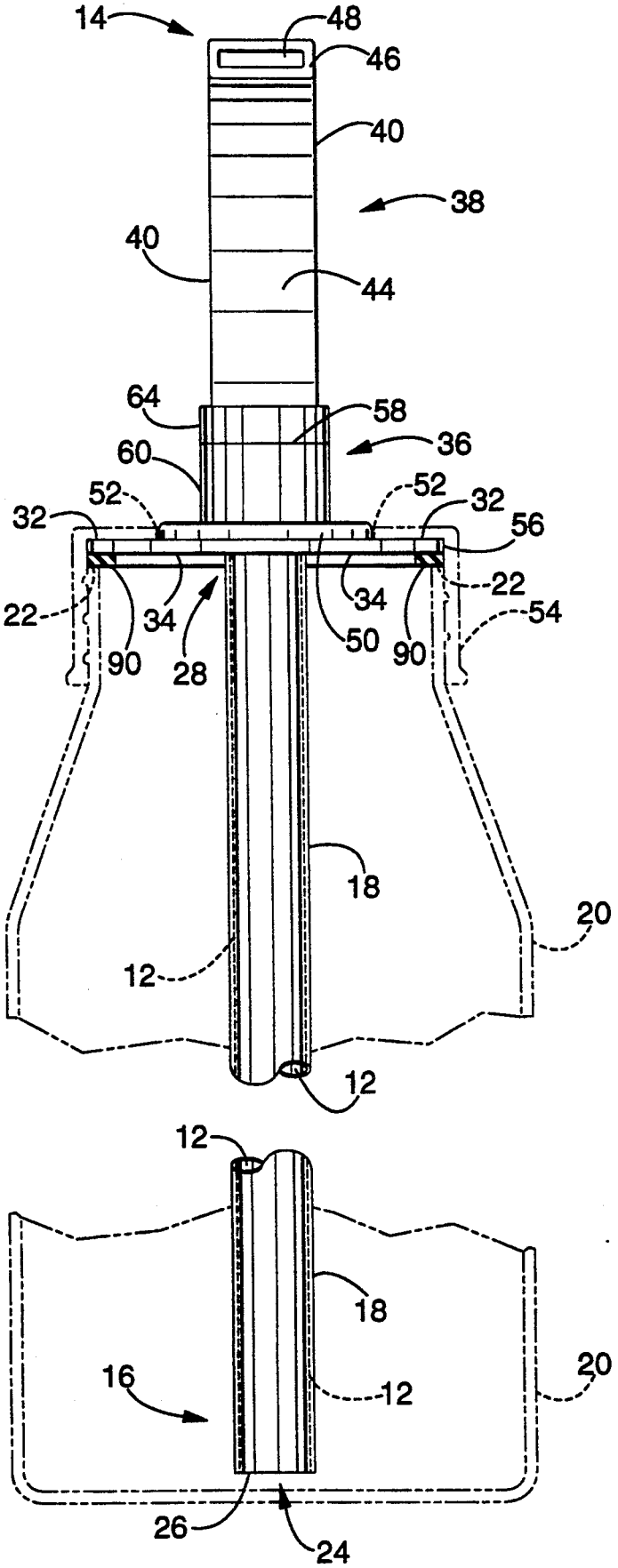
FIG. 2 is a side elevational, fragmentary view of the baby bottle straw of FIG. 1, shown mounted in a baby bottle for use, the baby bottle being shown in phantom.

Referring now specifically to the drawings, FIGS. 1 and 2 show the baby bottle straw of the present invention, which is generally identified herein with reference numeral 10.

Straw 10 is preferably constructed of polyethylene, or a similar plastic material. Many potential acceptable materials will be known to one skilled in the art, and any of those may be used, as long as the chosen material meets the specifications necessary to be considered food-grade plastic.

Straw 10 is tubular over its entire length; i.e. it has a continuous bore 12. Straw 10 has an upper end and a lower end, these being identified herein with reference numerals 14 and 16, respectively. Lower end 16 is comprised of an elongate, slightly flexible, but substantially rigid down-tube 18. Down-tube 18 preferably has a length that is slightly less than the depth of a standard baby bottle 20, measured from such a bottle's upper rim 22. Reference to a "standard" baby bottle herein will be understood to mean a bottle manufactured and sold by Evenflow, Gerber, Platex (as "Cherubs") and others, having similar dimensions (especially as to their necks and threads, and the caps that interchangeably fit them) and being the bottles in most widespread use. Bottles in both 8 oz. and 4 oz. sizes are offered. And, pre-packaged drinks in disposable bottles with the same standard dimensions in their necks, threads and caps are now being offered by Gerber, and perhaps others.

The down-tube 18 of a straw 10 adapted for use with such a standard baby bottle 20 of 8 oz. size preferably has a length of approximately 6.25 inches. The down-tube for a 4 oz. bottle (not shown) preferably has a length of approximately 3.75 inches.

Down-tube 18 has an opening 24 to straw 10's bore 12 at its lower terminus 26. Down-tube 18 projects below, and its upper end 28 is defined by, a flattened, disc-shaped collar 30. Collar 30 is oriented so as to have its broad upper and lower faces, numbered 32 and 34, respectively, in perpendicular relation to the long axis of down-tube 18. Collar 30's outside diameter is approximately 1.46 in., which is about the same outside diameter as a standard baby bottle 20's upper rim 22.

Upper end 14 of straw 10 is comprised of a shoulder 36 that stands immediately proximal to collar 30, and a short, curved, flattened mouthpiece 38 that is more distal to collar 30. As can be inferred from inspection of the figures, straw 10's bore 12 is circular at shoulder 36, and adopts a rectangular cross-section beyond shoulder 36 and more distal to collar 30. Curved side walls 40 of mouthpiece 38 taper toward their distal ends, while the widths of upper wall 42 and lower wall 44 remain equal and constant over their respective lengths. This causes mouthpiece terminus 46 to have a flattened, rectangular opening 48. Mouthpiece 38 is also somewhat flexible.

Regarding the angle at which mouthpiece 38 should project when straw 10 is in place on a bottle, the tangent to the curve of mouthpiece 38 is preferably at 75°, or so, to the long axis of bottle 20, and of straw 10 as primarily defined by down-tube 18. This angle is expected to yield the most satisfactory results, although a full range of angles between roughly 45° to 90° may work nearly as well.

The curve of mouthpiece 38, as primarily defined by side walls 40, is shaped to approximate the natural curve of the space between the upper surface of the tongue and the surface of the palate in a child's mouth. This shape also mimics a section of the curve of various elements of medical instruments used for establishing a clear airway in a child. The curve's purpose here is to reduce the likelihood of injury to the child should the bottle be bumped accidently, jamming the straw into the child's mouth. In such a case, it is thought that the preferred curve will tend to cause the mouthpiece to travel along the natural curve of the mouth instead of tending to jab upward into the palate as would be expected from a straight mouthpiece. However, it should be understood that the length of curved mouthpiece 38 of the present invention is somewhat shorter than curved elements used in medical instruments, because it is not intended that mouthpiece 38 project a great distance into the child's mouth in any circumstance. Instead, maximum penetration should not drive terminus 46 beyond, say, a line between the rears of the gums of the child's lower jaw—the rears of the gums being those points where molars would be expected to appear. Thus, the length of mouthpiece 38, as measured along its center line, should be roughly 2 inches, or so. This shape is also intended to maximize the child's drinking comfort in that it permits the bottle to be held in an upright, but slightly tipped, orientation toward the child while permitting mouthpiece terminus 46 to rest comfortably between the child's lips.

Collar 30's upper face 32 includes an upstanding ridge 50 having a circular shape and oriented in concentric relation with the outer circumference of collar 30. Ridge 50's preferred outer diameter of approximately 0.875 in. is dimensioned to permit it to fit snugly against inside edge 52 of a standard threaded annular bottle cap 54. And, as best seen in FIG. 2, collar 30's approximate 1.46 in. diameter gives collar 30's outer edge 56 just about the same diameter as bottle 20's top rim 22, thereby permitting collar 30 to seat securely within threaded annular cap 54.

Baby straw 10 must be of a single, integrated piece. That is, down-tube 18, collar 30 with ridge 50, shoulder 36 and mouthpiece 38 must all be integral with one another to have the desired utility. This can be accomplished in a single casting and, if so cast, the resulting baby straw falls within the bounds of the invention. However, it is also contemplated that an alternative embodiment of the inventive baby straw may include a one-way valve to prevent spilling a bottle's liquid contents.

Figure 3:
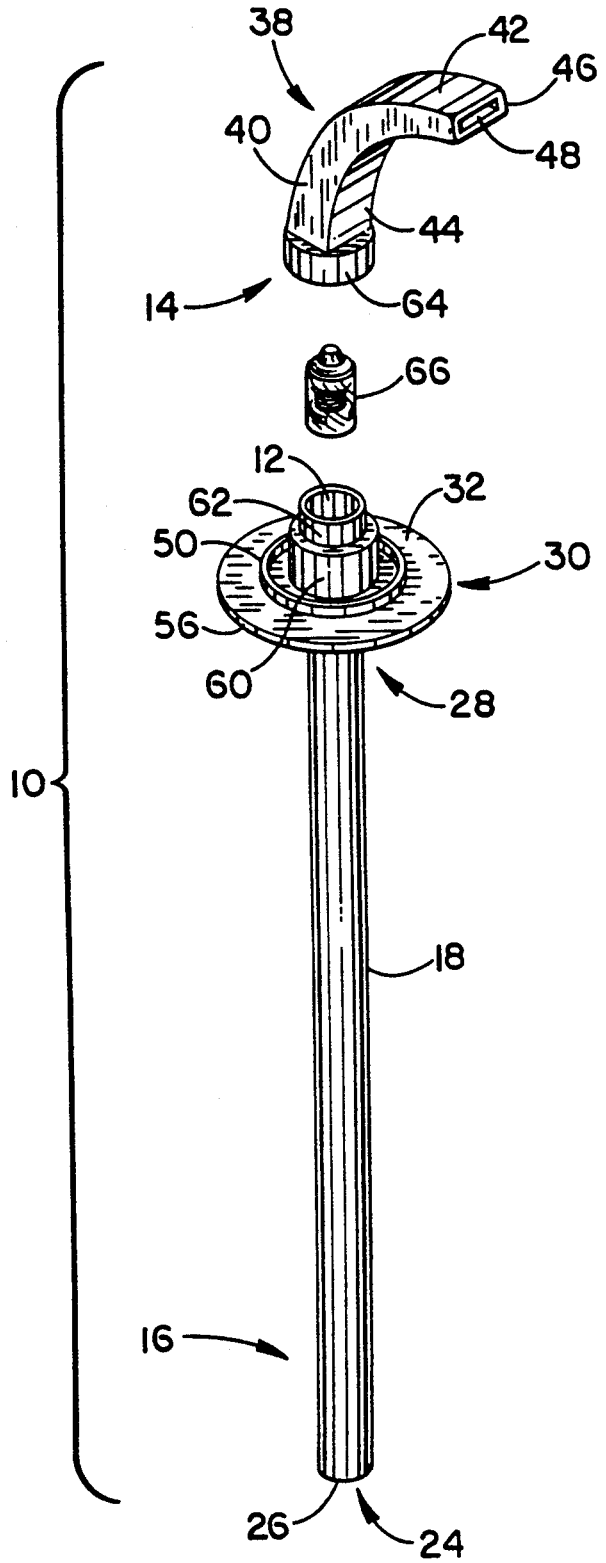
FIG. 3 is an exploded perspective view of the baby bottle straw of the present invention, showing the placement of a unidirectional valve below the mouthpiece in the straw's bore.

Inspection of FIGS. 1 and 2 reveals a weld line 58 in shoulder 36. Weld line 58 is only present in embodiments of the invention including a one-way valve. FIG. 3 shows that shoulder 36 may be comprised of two parts, a first of which includes a short, upstanding tubular protrusion 60 from collar 30's upper face 32 which defines the outside diameter of shoulder 36, and which further includes a coaxial tubular element 62 projecting somewhat above, and having a lesser outside diameter than, protrusion 60. The second part of shoulder 36 comprises a short tubular section 64 at the base of mouthpiece 38 having an outside diameter matching that of protrusion 60 from collar 30, and having an inside diameter slightly larger than the outside diameter of coaxial tubular element 62. It will be clear to one skilled in the art that short tubular section 64 beneath mouthpiece 38 must have sufficient interior depth to receive the full length of coaxial tubular element 62, permitting section 64 to seat flush against the end of protrusion 60. This is best seen in the cross-sections of FIGS. 4 and 5, wherein one-way valve 66 is shown seated within bore 12 of straw 10 at shoulder 36.

Weld 58 may be made in accordance with the preferred method in the art pertaining to the specific material chosen for construction of straw 10. Heat, adhesives or solvents may yield appropriate results, depending upon the material used. As the quality of this weld is critical to containing valve 66 within straw 10's bore 12, and as if valve 66 were to come loose it would pose a choking hazard, only the safest, most secure welding procedures and materials are appropriate here. And, quality control after completion of the assembly is crucial, as well.

Figure 4:
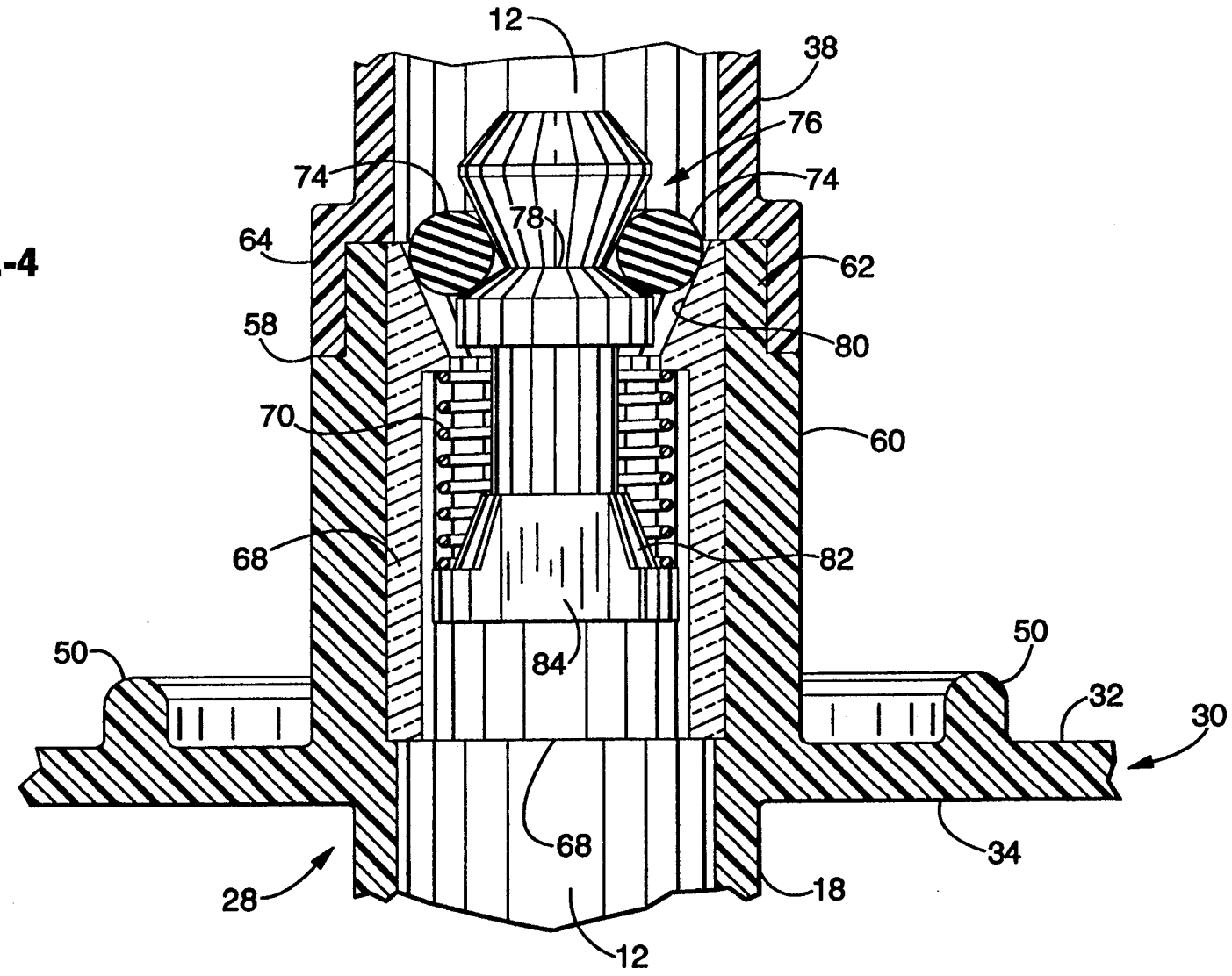
FIG. 4, is an enlarged sectional view of the unidirectional valve mounted in the bore of the inventive straw, the valve being shown in a closed position.
Figure 5:
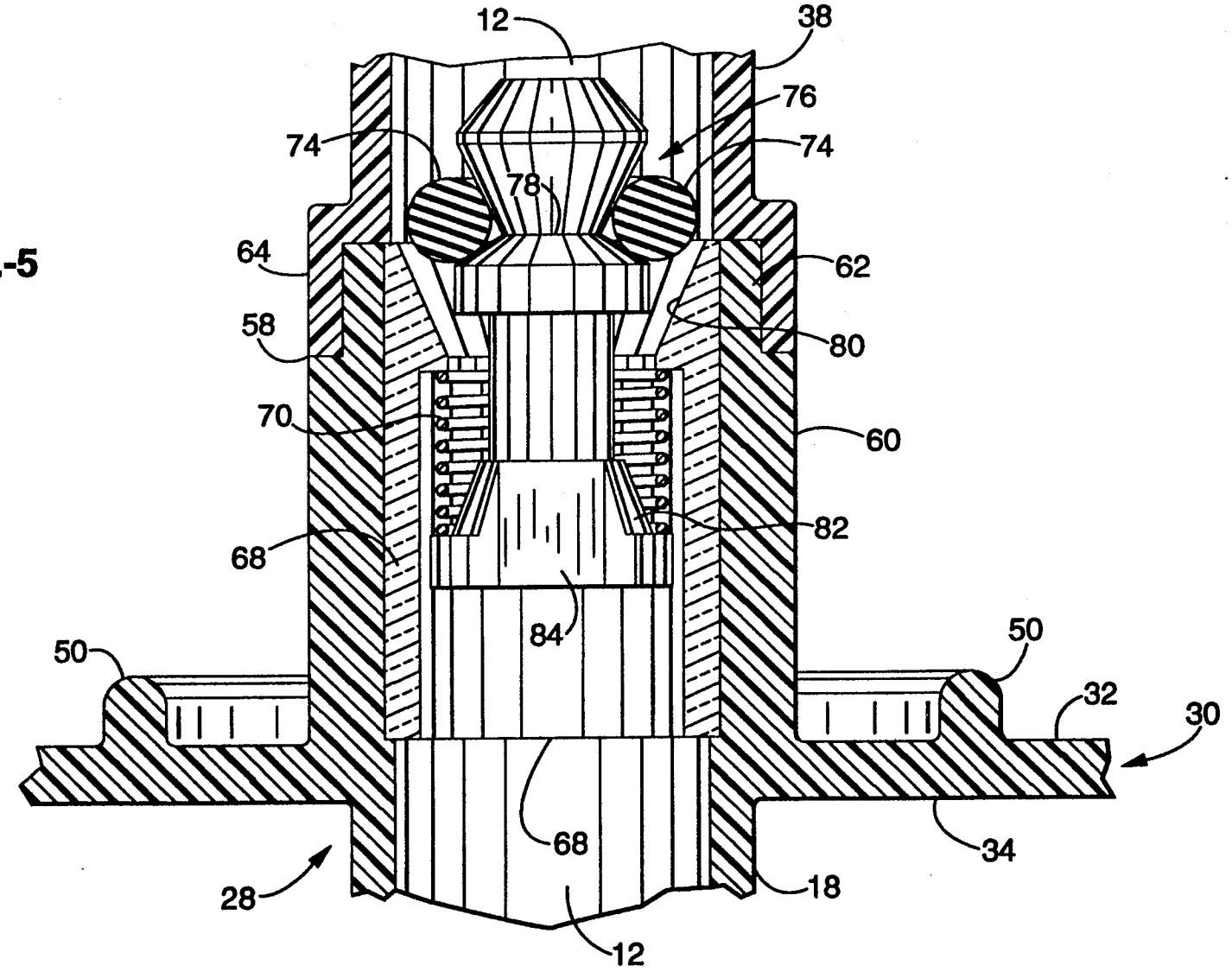
FIG. 5, is an enlarged sectional view of the unidirectional valve mounted in the bore of the inventive straw, the valve being shown in an open position.
Figure 6:
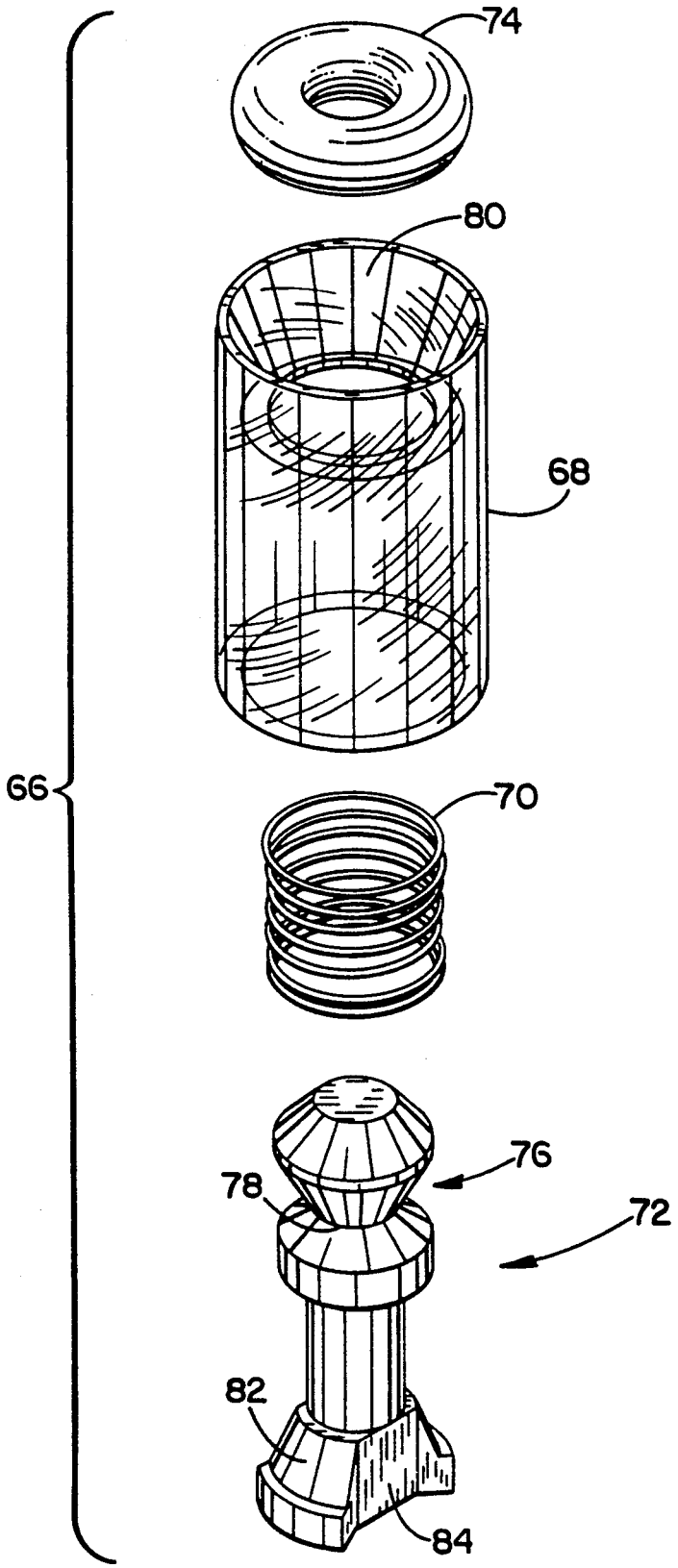
FIG. 6 is an exploded perspective view of the elements of the unidirectional valve.

FIGS. 4–6 show details of the one-way valve preferred for use in the instant embodiment of the invention. FIG. 6 illustrates that valve 66 is a poppet-type valve oriented in the bore 12 of straw 10 to permit one-directional flow from down-tube 18 toward mouthpiece 38. Valve 66 is comprised of a barrel 68, a coil spring 70, a plunger 72 and a seal ring 74. The head 76 of plunger 72 has a constricted waist 78 in which seal ring 74 nests. Valve seat 80 of barrel receives seal-ring 74 when valve 66 is in a closed position as shown in FIG. 4. Coil spring 70 holds seal ring 74 against valve seat 80 because spring is contained between the underside of valve seat 80 and hip 82 of plunger 72. Cutouts 84 in the hip area of plunger 72 permit fluid flow past plunger 72 and through valve 66 when coil spring 70 is compressed as in FIG. 5. Spring 70 should be chosen so that valve 66 has an exceedingly low cracking pressure, i.e. a cracking pressure approximately equivalent to, or less than, the negative pressure that needs to be created by a child's mouth to draw up liquid successfully from a bottle through straw 10. Of course, coil spring 70 should be of a noncorrosible material, and all the other elements of valve 66 should be of the proper material and quality for use with food products. Further, valve 66 should be constructed so as to make it exceedingly unlikely that any part thereof will break away and travel through straw 10.

As will be known to those skilled in the art, (depending on the strength of spring 70) it may be desirable to provide straw 10 with some pressure venting mechanism to avoid the problems of vacuum formation within baby bottle 20. A port or vent may be added for such purpose, as desired.

Figure 7:
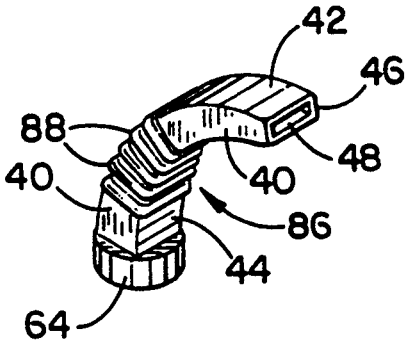
FIG. 7 is a perspective view of an alternative, more flexible, mouthpiece for the inventive baby bottle straw.

In yet another embodiment of the invention, an alternative, more flexible mouthpiece 86, as shown in FIG. 7, is contemplated. Flexible mouthpiece is essentially the same as mouthpiece 38, except that it includes a series of several convolutions 88 along the middle of its length. Convolutions 88 simply comprise consecutive widenings and narrowings of the cross-section of mouthpiece 86. Of course, flexible mouthpiece 86 may be employed either with, or without, unidirectional valve 66 being mounted in the straw's bore.

In use, the inventive baby bottle straw is simple to install in a standard baby bottle 20. One simply fills the standard bottle with the desired drinking liquid, and drops straw 10's down-tube 18 into the bottle. For absolute assurance of leak-free operation it may be desirable to place a thin gasket 90 between bottle 20's upper rim 22 and collar 30's lower face 34 as in FIG. 2. Threaded annular bottle cap 54 is brought down over straw 10 so that mouthpiece 38 (or 86) passes through the opening in cap 54. Ridge 50 will register with inside edge 52 of cap 54 as collar 30 seats securely therewithin. Cap 54 can then be screwed down to bind straw 10 in place. Removal simply requires the reverse of the foregoing. Cleaning the straw is easily accomplished by running hot soapy water through it from its down-tube end. And, the materials from which it is constructed should make it dishwasher safe.

The foregoing detailed disclosure of the inventive baby bottle straw 10 is considered as only illustrative of the preferred embodiment of, and not a limitation upon the scope of, the invention. Those skilled in the art will envision many other possible variations of the structure disclosed herein that nevertheless fall within the scope of the following claims. For example, the dimensions may be varied from those preferred for fitting a standard baby bottle, to dimensions suited to accommodate other similarly-constructed drinking vessels without departing from the spirit of the invention. And, alternative uses for this inventive baby bottle straw may later be realized. Accordingly, the scope of the invention should be determined with reference to the appended claims, and not by the examples which have herein been given.

I claim:

1. A device for delivery of liquid from a baby bottle, said baby bottle having an upper rim approximately 1.46 inches in diameter, said bottle further including a threaded, annular bottle cap having an inside edge with a diameter of approximately 0.875 inches, said device comprising:

a. an elongate tube having first and second ends, wherein said first end of said tube is relatively flexible and includes a terminus which is adapted for drinking from and wherein said second end of said tube is substantially rigid and adapted to be submerged in said liquid in said bottle; and, b. a flattened, disc-shaped collar integral with each tube and oriented in perpendicular relation to said tube's longitudinal axis between said tube's first and second ends, said collar being so constructed and arranged as to be able to be bound securely to said bottle's upper rim by said annular cap such that said first end of said tube projects through said annular cap said collar further including an annular ridge having an outside diameter projecting from a surface of said collar, said ridge being concentric with said collar and projecting toward said first end of said tube, and wherein said outside diameter permits said ridge to fit securely against said inside edge of said annular cap.

2. The device of claim 1, wherein said device is particularly adapted to delivery of liquid from said baby bottle to a baby or young child, wherein said baby or young child has a curved space between an upper surface of its tongue and a surface of its palate, said device further including a curved portion between said collar and said terminus which is adapted to approximate said curve of said space between said upper surface of said baby or young child's tongue and said surface of said baby or young child's palate.

3. The device of claim 2, wherein said device is further particularly adapted to prevent said first end from projecting into said baby's or young child's mouth beyond a line between the rears of the gums of said baby's or young child's lower jaw, said tube's first end's length from said collar to said terminus is adapted to be approximately the distance from said baby's or young child's lips to a line between the rears of the gums of said baby's or young child's lower jaw.

4. The device of claim 1 wherein said tube's first end includes a short convoluted portion, whereby said tube's first end is made more flexible.

5. The device of claim 1 further including a unidirectional valve disposed securely within said tube, and wherein said valve is oriented to permit liquid to flow only from said tube's second end to said tube's first end.

6. The device of claim 1 wherein said tube's first end's terminus has a flattened cross-section.

7. The device of claim 6 wherein said tube's first end is tapered from an open cross-section adjacent said collar to a flattened cross-section at its terminus.

8. A device for delivery of liquid from a baby bottle, comprising:

a. an elongate tube having first and second ends, wherein said first end of said tube includes a flattened terminus and, further, is curved such that a tangent to the curve at said first end's terminus is approximately at a 75° angle to said tube's longitudinal axis as primarily defined by said tube's second end, said second end of said tube being adapted to be submerged in said liquid in said bottle;

b. convolutions in a mid-portion of said tube's first end;

c. a flattened, disc-shaped collar integral with said tube and oriented in perpendicular relation to said tube's longitudinal axis between said tube's first and second ends, and closer to said tube's first end;

d. an annular ridge projecting from said collar's surface, said ridge being concentric with said collar and projecting toward said tube's first end, and wherein said ridge's outward diameter permits said ridge to fit securely against said annular cap's inside edge; and, e. a unidirectional valve disposed within said tube's first end, adjacent said collar, wherein said valve is oriented to permit liquid to flow only from said tube's second end to said tube's first end.

9. A device for containing and delivering liquid comprising:

a. a bottle having an upper rim approximately 1.46 inches in diameter;

b. screw threads disposed on said bottle's outer surface adjacent said rim;

c. an annular bottle cap having inside threads adapted to mate with said threads on said bottle's rim, and further including an inside edge with a diameter of approximately 0.875 inches;

d. an elongate tube having first and second ends, wherein said first end of said tube includes a flattened terminus and, further, is curved such that a tangent to the curve at said first end's terminus is approximately at a 75° angle to said tube's longitudinal axis as primarily defined by said tube's second end, said second end of said tube being adapted to be submerged in said liquid in said bottle;

e. convolutions in a mid-portion of said tube's first end;

f. a flattened, disc-shaped collar integral with said tube and oriented in perpendicular relation to said tube's longitudinal axis between said tube's first and second ends, and closer to said tube's first end;

g. an annular ridge projecting from said collar's surface, said ridge being concentric with said collar and projecting toward said tube's first end, and wherein said ridge's outside diameter permits said ridge to fit securely against said annular cap's inside edge; and, h. a unidirectional valve disposed within said tube's first end, adjacent said collar, wherein said valve is oriented to permit liquid to flow only from said tube's second end to said tube's first end.

* * * * *